US010739115B2

(12) United States Patent
Loehken et al.

(10) Patent No.: US 10,739,115 B2
(45) Date of Patent: Aug. 11, 2020

(54) SHAPED CHARGE LINER, METHOD OF MAKING SAME, AND SHAPED CHARGE INCORPORATING SAME

(71) Applicant: DynaEnergetics GmbH & Co. KG, Troisdorf (DE)

(72) Inventors: Joern Olaf Loehken, Troisdorf (DE); Francisco Montenegro, Bonn (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 89 days.

(21) Appl. No.: 16/004,541

(22) Filed: Jun. 11, 2018

(65) Prior Publication Data

US 2018/0372460 A1 Dec. 27, 2018

Related U.S. Application Data

(60) Provisional application No. 62/523,991, filed on Jun. 23, 2017.

(51) Int. Cl.

| | |
|---|---|
| ***F42B 1/032*** | (2006.01) |
| ***B22F 1/00*** | (2006.01) |
| ***E21B 43/117*** | (2006.01) |
| ***F42B 1/036*** | (2006.01) |
| *F42B 1/028* | (2006.01) |

(52) U.S. Cl.

CPC ..... *F42B 1/032* (2013.01); *B22F 1/0011* (2013.01); *E21B 43/117* (2013.01); *F42B 1/036* (2013.01); *B22F 2301/052* (2013.01); *B22F 2301/10* (2013.01); *B22F 2301/15* (2013.01);

(Continued)

(58) Field of Classification Search

CPC ..... B22F 1/0011; B22F 1/0014; F42B 1/032

See application file for complete search history.

(56) References Cited

U.S. PATENT DOCUMENTS 2,650,539 A 9/1953 Greene
3,077,834 A * 2/1963 Caldwell ..... E21B 43/117 102/306

(Continued)

FOREIGN PATENT DOCUMENTS

DE 102005059934 A1 12/2005
EP 0144477 B1 3/1987

(Continued)

OTHER PUBLICATIONS

Jacobi et al., Optical Properties of Ternary B Electronphases based on NiAl, J. Phys. Chem. Solids, 1973, vol. 34, 12 pages, Pergamon Press, Great Britain.

(Continued)

*Primary Examiner* — Stephen Johnson
(74) *Attorney, Agent, or Firm* — Moyles IP, LLC

(57) ABSTRACT

A shaped charge liner including a composition of metal powders. Each metal powder may include one or more grain sizes, which may be different from other powder grain sizes. The metal powders may include transition metal powders, non-transition metal powders, and a bronze metal powder. The metal powders may include a malleable binding metal powder, such as bronze, and a non-malleable binding metal powder. A shaped charge including such liners is also disclosed, as well as a method of making the shaped charge liner, and a shaped charge including such shaped charge liner.

19 Claims, 7 Drawing Sheets

(52) U.S. Cl.
CPC ..... *B22F 2301/30* (2013.01); *B22F 2304/10* (2013.01); *F42B 1/028* (2013.01)

(56) References Cited

U.S. PATENT DOCUMENTS

| | | | | |
|---|---|---|---|---|
| 3,235,005 | A | 2/1966 | Delacour | |
| 3,375,108 | A | 3/1968 | Wyman, Sr. et al. | |
| 3,675,575 | A | 7/1972 | Bailey et al. | |
| 4,613,370 | A | 9/1986 | Held et al. | |
| 4,766,813 | A | 8/1988 | Winter et al. | |
| 5,083,615 | A | 1/1992 | McLaughlin et al. | |
| 5,098,487 | A | 3/1992 | Brauer et al. | |
| 5,212,343 | A | 5/1993 | Brupbacher et al. | |
| 5,259,317 | A | 11/1993 | Lips | |
| 5,413,048 | A | 5/1995 | Werner et al. | |
| 5,551,344 | A | 9/1996 | Couet et al. | |
| 5,567,906 | A | 10/1996 | Reese et al. | |
| 5,656,791 | A | 8/1997 | Reese et al. | |
| 5,814,758 | A | 9/1998 | Leidel | |
| 5,859,383 | A | 1/1999 | Davison et al. | |
| 6,349,649 | B1 | 2/2002 | Jacoby et al. | |
| 6,354,219 | B1 | 3/2002 | Pratt et al. | |
| 6,354,222 | B1 | 3/2002 | Becker et al. | |
| 6,371,219 | B1 | 4/2002 | Collins et al. | |
| 6,378,438 | B1 | 4/2002 | Lussier et al. | |
| 6,494,139 | B1 | 12/2002 | Powell | |
| 6,564,718 | B2 | 5/2003 | Reese et al. | |
| 6,588,344 | B2 | 7/2003 | Clark et al. | |
| 6,634,300 | B2 | 10/2003 | Reese et al. | |
| 6,655,291 | B2 | 12/2003 | Pratt et al. | |
| 6,668,726 | B2 | 12/2003 | Lussier | |
| 6,962,634 | B2 | 11/2005 | Nielson et al. | |
| 7,011,027 | B2 | 3/2006 | Reese et al. | |
| 7,036,594 | B2 | 5/2006 | Walton et al. | |
| 7,261,036 | B2 | 8/2007 | Bourne et al. | |
| 7,278,353 | B2 | 10/2007 | Langan et al. | |
| 7,278,354 | B1 | 10/2007 | Langan et al. | |
| 7,393,423 | B2 | 7/2008 | Liu | |
| 7,712,416 | B2 | 5/2010 | Pratt et al. | |
| 7,721,649 | B2 | 5/2010 | Hetz et al. | |
| 7,749,345 | B2 | 7/2010 | Wood | |
| 7,775,279 | B2 | 8/2010 | Marya et al. | |
| 7,811,354 | B2 | 10/2010 | Leidel et al. | |
| 7,913,758 | B2 | 3/2011 | Wheller et al. | |
| 7,921,778 | B2 | 4/2011 | Stawovy | |
| 7,987,911 | B2 | 8/2011 | Rhodes et al. | |
| 8,037,829 | B1 | 10/2011 | Waddell et al. | |
| 8,075,715 | B2 | 12/2011 | Ashcroft et al. | |
| 8,122,833 | B2 | 2/2012 | Nielson et al. | |
| 8,156,871 | B2 | 4/2012 | Behrmann et al. | |
| 8,220,394 | B2 | 7/2012 | Bates et al. | |
| 8,245,770 | B2 | 8/2012 | Bell et al. | |
| 8,381,652 | B2 | 2/2013 | Glenn | |
| 8,544,563 | B2 | 10/2013 | Bourne et al. | |
| 8,584,772 | B2 | 11/2013 | Yang et al. | |
| 8,701,767 | B2 | 4/2014 | Andrzejak et al. | |
| 8,726,995 | B2 | 5/2014 | Bell et al. | |
| 9,080,431 | B2 | 7/2015 | Bell et al. | |
| 9,080,432 | B2 | 7/2015 | Yang et al. | |
| 9,644,460 | B2 | 5/2017 | Bell et al. | |
| 9,862,027 | B1 * | 1/2018 | Loehken | B22F 1/0011 |
| 2002/0112564 | A1 | 8/2002 | Leidel et al. | |
| 2002/0129726 | A1 | 9/2002 | Clark et al. | |
| 2003/0037693 | A1 | 2/2003 | Wendt, Jr. et al. | |
| 2003/0131749 | A1 | 7/2003 | Lussier | |
| 2004/0156736 | A1 | 8/2004 | Ocher et al. | |
| 2005/0100756 | A1 | 5/2005 | Langan et al. | |
| 2005/0115448 | A1 | 6/2005 | Pratt et al. | |
| 2006/0266551 | A1 | 11/2006 | Yang et al. | |
| 2007/0053785 | A1 | 3/2007 | Hetz et al. | |
| 2007/0227390 | A1 | 10/2007 | Palmateer | |
| 2008/0282924 | A1 | 11/2008 | Saenger et al. | |
| 2008/0289529 | A1 | 11/2008 | Schilling | |
| 2009/0078144 | A1 | 3/2009 | Behrmann et al. | |
| 2009/0294176 | A1 * | 12/2009 | Gessel | F42B 1/032 175/57 |
| 2010/0230104 | A1 | 9/2010 | Noelke et al. | |
| 2011/0056691 | A1 * | 3/2011 | King | B22F 3/1258 166/298 |
| 2013/0014661 | A1 * | 1/2013 | Lumley | F42B 1/032 102/307 |
| 2013/0126238 | A1 | 5/2013 | Church et al. | |
| 2013/0340643 | A1 | 12/2013 | Yang et al. | |
| 2015/0226533 | A1 | 8/2015 | Grattan | |
| 2015/0376992 | A1 | 12/2015 | Grattan et al. | |

FOREIGN PATENT DOCUMENTS

| | | | | |
|---|---|---|---|---|
| EP | 1682846 | B1 | 7/2006 | |
| EP | 2320025 | A1 | 5/2011 | |
| EP | 1812771 | B1 | 3/2015 | |
| FR | 2749382 | A1 | 12/1997 | |
| WO | WO-2014193416 | A1 | 12/2014 | |
| WO | WO-2016137883 | A1 * | 9/2016 | E21B 43/117 |
| WO | WO-2017029240 | A1 | 2/2017 | |

OTHER PUBLICATIONS

Valery Marinov, Powder Metallurgy Process, Manufacturing Technology, Oct. 2000, 4 pgs., http://me.emu.edu.tr/me364/ME364_PM_process.pdf.

Zhang et al., The prediction of solid solubility of alloys: developments and applications of Hume-Rothery's rules, 2010, 40 pgs, J. of Crystallization Physics and Chemistry.

Michael D. Tucker, Characterization of Impact Initiation of Aluminum-Based Intermetallic-Forming Reactive Materials, Thesis, Dec. 2011, 84 pages, Georgia Inst. of Technology.

Mirko Vivus, Reduction of the skin cause by perforation using reactive liner material, Diploma Thesis, Jul. 12, 1971, 82 pgs, Freiberg University of Mining & Technology.

M. Hicks, Metals and alloys. Hume-Rothery rules., Dec. 2003, 31 pgs, Shenyang National Lab. for Materials Science, www.synl.ac.cn/org/non/zul/knowledge/Hume-Rothery-rules.pdf.

TLS Technik, Titanium Powder, May 22, 2001, 3 pgs., http://www.tls-technik.de/e_4.html.

Purdue Science-Bodner Research Web, Transition Metals, Jun. 3, 2006, 7 pgs., http://chemed.chem.purdue.edu/genchem/topicreview/bp/ch12/trans.php.

Donaldson et al., Advances in Powder Metallurgy & Particulate Material—2012, paper presented at 2012 International Conference, Jun. 10-13, 2012, Nashville, TN., 13 pgs.

Global Security. Org, Properties and Uses of Metal—Chaper 1, Sep. 23, 2003, 14 pgs, https://www.globalsecurity.org/military/library/policy/navy/nrtc/14250_ch1.pdf.

Partial International Search Report and Invitation to Pay Additional Fees of International App. No. PCT/EP2018/064473, dated Jul. 26, 2018, which is in the same family as U.S. Appl. No. 16/004,541, 14 pgs.

Fischer et al., A Survey of Combustible Metals, Thermites, and Intermetallics for Pyrotechnic Applications, Sandia National Laboratories, Jul 1-3, 1996, 15 pgs, Albuquerque,NM.

Behrmann et al., Perforating Practices That Optimize Productivity, Oilfield Review, Spring 2000, 22 pages, perfo.slb.ru/docs/pptop.pdf.

Church et al., Investigation of a Nickel-Aluminum Reactive Shaped Charged Liner, Journal of Applied Mechanics, May 2013, 13 pgs, vol. 80, ASME.

Haggerty et al., A Comparative Assessment of 3 ⅜-in. Perforators Using 'Reactive' and 'Non-reactive' Shaped Charges, Sep. 23-25, 2009, 10 pgs, SPE 125752, SPE.

Dynaenergetics, Field experience with the DYNAenergetics DPEX reactive liner charges, Presentation, Oct. 8, 2015, 27 pages.

Dynaenergetics, Don't Miss Out on Improved Perforation! Shaped charges from DYNAenergetics, DPEX Charge Brochure, 4 pages, azul-plus.squarespace.com/s/dyna_dpex_brochure.pdf.

Mizutani et al, e/a Determination for the transition metal element TM in Al—Cu—Tm—Si (Tm=Fe&Ru) approximants & B2-compounds by means of the FLAPW-Fourier method, Jun. 2008, 4 pgs.

(56) References Cited

OTHER PUBLICATIONS

Massalski et al., ELECTRONTiC Structure of Hume-Rothery Phases, Nov. 15, 1977, 5 pgs., Carnegie-Mellon University, Pittsburgh, PA, USA.
Wade et al., Field Tests Indicate New Perforating Devices Improve Efficiency in Casing Completion Operations, Oct. 1962, 5 pgs., Journal of Petroleum Technology.
Matt Bell, Reactive® Perforating:The New Ballistic Frontier That's Revolutionizing Well Completions, Jul. 16, 2009, 41 pgs., Society of Petroleum Engineers, Bangkok Chapter.
Hardesty et al., Translation of New Experimental Test Methods of the Evaluation & Design of Shaped Charge Perforators to Field Applications, Jun. 7-10, 2011, 15 pgs, SPE.
Geodynamics, Technology/Product Preview, OTC Luncheon Presentation, Apr. 30, 2007, 35 pgs., http://www.perf.com/.
Bell et al., Reactive Perforating: Conventional and Unconventional Applications, Learnings and Opportunities, May 27-29, 2009, 6 pgs., Society of Professional Engineers.
Donaldson et al., Advances in Powder Metallurgy & Particulate Materials—2012, Jun. 10-13, 2012, 13 pgs., Proceedings of the 2012 International Conference, Princeton, NJ, USA.
Hardt, Incendiary Potential of Exothermic Intermetallic Reactions, Jul. 1971, 79 pgs., Air Force Armament Laboratory, Eglin Air Force Base, FL, USA.
Bartz et al., Let's Get the Most Out of Existing Wells, Oilfield Review, Winter 1977, 20 pages.
Universal Filters, Inc., Mesh to Micron Conversion Chart, Oct. 26, 2008, 2 pgs., http://www.universalfilters.com/MMCC.html.
Henz et al., Molecular Dynamics Simulation of the Kinetic Reaction of Nickel and Aluminum Nanoparticles, Mar. 2010, 36 pgs, Army Research Laboratory, Aberdeen Proving, MD.
Bell et al., New titanium-lined shaped-charge perforator, The Oil and Gas Journal, Nov. 5, 1962, 5 pages.
Bell et al., Next-generation perforating system enhances testing, treatment of fracture stimulated wells, Drilling Contractor, Nov./Dec. 2008, 8 pages.
International Search Report and Written Opinion of the International App. No. PCT/EP2018/064473, dated Sep. 17, 2018, which is in the same family as U.S. Appl. No. 16/004,541, 20 pgs.
Duffy et al., Effect of Liner Grain Size on Shaped Charge Jet Performance and Characteristics, Apr. 7, 1987, 48 pgs., US Army Ballistic Research Laboratory, Aberdeen Proving Ground, Maryland.

* cited by examiner

SHAPED CHARGE LINER, METHOD OF MAKING SAME, AND SHAPED CHARGE INCORPORATING SAME

CROSS-REFERENCE TO RELATED APPLICATIONS

This application claims the benefit of U.S. Provisional Application No. 62/523,991, filed Jun. 23, 2017, which is incorporated herein by reference in its entirety.

FIELD

A shaped charge liner formed from a composition of powders is generally described. More specifically, a shaped charge having a shaped charge liner including a composition of metal powders is described.

BACKGROUND

As part of a well completion process, cased-holes/wellbores are perforated to allow fluid or gas from rock formations (reservoir zones) to flow into the wellbore. Perforating gun string assemblies are conveyed into vertical, deviated or horizontal wellbores, which may include cemented-in casing pipes and other tubulars, by slickline, wireline or tubing conveyance perforating (TCP) mechanisms, and the perforating guns are fired to create openings/perforations in the casings and/or liners, as well as in surrounding formation zones. Such formation zones may include subterranean oil and gas shale formations, sandstone formations, and/or carbonate formations.

Often, shaped charges are used to form the perforations within the wellbore. These shaped charges serve to focus ballistic energy onto a target, thereby producing a round perforation hole (in the case of conical shaped charges) or a slot-shaped/linear perforation (in the case of slot shaped charges) in, for example, a steel casing pipe or tubing, a cement sheath and/or a surrounding geological formation. In order to make these perforations, shaped charges typically include an explosive/energetic material positioned in a cavity of a housing (i.e., a shaped charge case), with or without a liner positioned therein. It should be recognized that the case, casing or housing of the shaped charge is distinguished from the casing of the wellbore, which is placed in the wellbore after the drilling process and may be cemented in place in order to stabilize the borehole prior to perforating the surrounding formations. Often, the explosive materials positioned in the cavity of the shaped charge case are selected so that they have a high detonation velocity and pressure. When the shaped charges are initiated, the explosive material detonates and creates a detonation wave, which will generally cause the liner (when used) to collapse and be ejected/expelled from the shaped charge, thereby producing a forward moving perforating material jet that moves at a high velocity. The perforating jet travels through an open end of the shaped charge case which houses the explosive charge, and serves to pierce the perforating gun body, casing pipe or tubular and surrounding cement layer, and forms a cylindrical/conical tunnel in the surrounding target geological formation.

Typically, liners include various powdered metallic and non-metallic materials and/or powdered metal alloys, and binders, selected to generate a high-energy output or jet velocity upon detonation and create enlarged hole (commonly referred to as "big hole") or deep penetration ("DP") perforations. These liners, however, may leave undesirable slugs/residuals of the liner material in the perforation tunnel, which may reduce and/or block flow of the fluid/gas in the perforation tunnel. Additionally, the perforating jet formed by typical liners may form a crushed zone (i.e., perforation skin, or layer of crushed rock between the round perforation/slot-shaped perforation tunnel and the reservoirs) in the surrounding formation, which reduces the permeability of the surrounding formation and, in turn, limits the eventual flow of oil/gas from the reservoir.

Efforts to reduce slug formation, further clear the perforation tunnel, and/or remove the crushed zone have included the use of reactive liners. Such reactive liners are typically made of a plurality of reactive metals that create an exothermic reaction upon detonation of the shaped charge in which they are utilized.

Powdered metallic materials often used in the reactive liners include one or more of lead, copper, aluminum, nickel, tungsten, bronze and alloys thereof. Such liners are, for instance, described in U.S. Pat. Nos. 3,235,005, 3,675,575, 5,567,906, 8,075,715, 8,220,394, 8,544,563 and German Patent Application Publication No. DE102005059934. Some of these powdered metallic materials may be heterogeneous or non-uniformly distributed in the liner, which may lead to reduced performance and/or non-geometric perforation holes. Another common disadvantage of these liners is that they may not be able to sufficiently reduce slug formation, clear the perforation tunnel, and/or remove the crush zone formed following detonation of the shaped charge.

Some metallic liner materials include powdered metallic materials having grain sizes that are less than 50 micrometers in diameter, while others may include larger grain sizes. Difficulty mixing the metals during the liner formation process may result in imprecise or non-homogeneous individual liner compositions with heterogeneous areas (i.e., areas where the liner composition is predominantly a single element, rather than a uniform blend) within the liner structure. Efforts to improve mass producability of liners are sometimes met with compromised performance of the liners.

In view of the disadvantages associated with currently available methods and devices for perforating wellbores using shaped charges, there is a need for a device and method that provides a composition including metal powders for use in a shaped charge liner that is capable of generating an energy sufficient to initiate an exothermic reaction upon detonation of the shaped charge. Additionally, there is a need for shaped charge liners capable of forming an exothermic reaction to generate additional thermal energy. Further, there is a need for a liner, and/or a shaped charge including a liner, having a homogenous composition of metal powders. Finally, there is a need for a shaped charge liner in which its components allow for a more effective perforating jet, without adding significantly to overall shaped charge costs.

BRIEF DESCRIPTION

According to an aspect, the present embodiments may be associated with a shaped charge liner. Such shaped charge liners may create ideal perforations for stimulation of the flow of oil/gas from oil reservoirs/wellbores, and uniform distribution of perforation tunnels that facilitate reduction in recovery time from the reservoirs.

According to an aspect, the shaped charge liner includes a composition of two or more transition metal powders and one or more non-transition metal powders. Each of the transition metal powders and the non-transition metal powders include one or more grain sizes. According to an aspect, the shaped charge liner includes a composition of a plurality of malleable binding metal powders and a non-malleable metal powder. Each of the malleable binding metal powder and the non-malleable metal powder includes one or more grain sizes.

Embodiments of the present disclosure may be associated with a shaped charge liner including a plurality of metal powders. Such metal powders include bronze, lead, aluminum, and nickel. Each metal powder is present in an amount that is less than 40% w/w of a total weight of the composition. Additionally, each metal powder has a distinct grain size. The composition may include a nonmetal powder present in an amount that is less than 40% w/w of the total weight of the composition. Optionally, the composition may include a binder and a lubricant material blended with the composition of powders.

Further embodiments of the disclosure are associated with a shaped charge having a case, an explosive load, and a shaped charge liner. The case has a plurality of walls including a side wall and a back wall, which together define a hollow interior within the case. The explosive load is disposed within the hollow interior, and the shaped charge liner is disposed adjacent the explosive load in a manner that retains the explosive load within the hollow interior of the shaped charge. The shaped charge liner may be configured substantially as described hereinabove. The shaped charges including the aforementioned liners demonstrate increased consistency of performance, as well as increased productivity ratios.

The present disclosure may further be associated with a method of forming a shaped charge liner. The method includes mixing a composition of metal powders to form a homogenous powder blend, and forming the homogenous powder blend into a desired liner shape. The metal powders used in the homogenous powder blend may include two or more transition metal powders having one or more grain sizes, and one or more non-transition metal powder also having one or more grain sizes.

Embodiments of the present embodiments may further be associated with a method of making a shaped charge having a shaped charge liner. The method includes disposing an explosive load within a shaped charge. The shaped charge has a case having a side wall/(s), a back wall, and a hollow interior defined by the side and back walls. The explosive load is disposed within the hollow interior of the case, so that the explosive load is adjacent the back wall, the initiation point, and a least a portion of the side wall. A shaped charge liner having a composition of metal powders is formed, substantially as described hereinabove. The metal powders are each present in the composition in amounts less than 40% w/w of the composition, and each powder has one or more distinct grain sizes. The method further includes installing the shaped charge liner in the hollow interior of the case and adjacent the explosive load, so that the explosive load is positioned between the back and side walls, and the shaped charge liner.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

For purposes of illustrating features of the embodiments, embodiments will now be introduced and referenced throughout the disclosure. Those skilled in the art will recognize that these examples are illustrative and not limiting and are provided purely for explanatory purposes.

As used herein, the term "homogenous powder blend" refers to an even/uniform particle size distribution of all the powders of the composition. A liner having a homogenous powder blend may include a powder distribution variance, i.e., a standard deviation in the grain size distribution, of 1 to 5%.

As used herein "grain size/(s)" refers to the diameters of each grain of a powder, such as a metallic/metal powder having generally spherical shaped grains, and also refers to irregular (non-spherical) shaped grains. One or more of the metal powders may include grains of two or more different grain sizes, each within a defined range, referred to as a "grain size distribution". As used herein, "grain size distribution" refers to the apportionment of the grain sizes of a powder when, for instance, one grain has a size that is smaller or larger than the size of another grain. Accordingly, the term "grain size" as used throughout refers more broadly to the range of grain sizes within a particular grain size distribution, rather than one individual grain size, unless specified otherwise. As would be understood by one of ordinary skill in the art, manufacturers of metallic powders traditionally sell powders in stated ranges or grain size distributions. While it is possible to have individual grains present within a sample that vary in size, the predominant number of grain sizes (or the particle size distribution) within the sample will be in the stated range/(s). Variability within a stated grain size range may vary by about +/−1 to 5%, and in an embodiment, by about +/−1-3%.

Figure 1A:
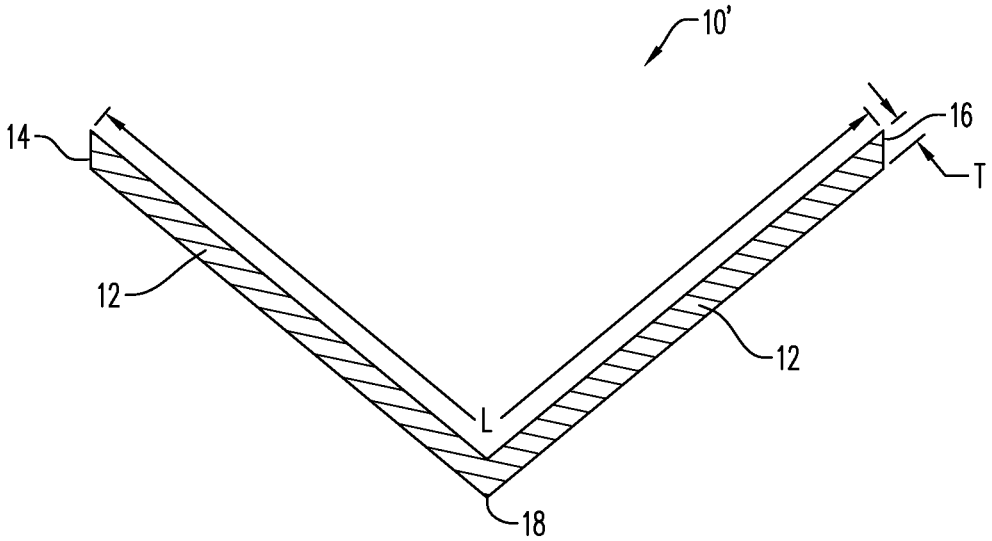
FIG. 1A is a cross-sectional view of a conical shaped charge liner having a composition of metal powders, according to an embodiment.
Figure 1B:
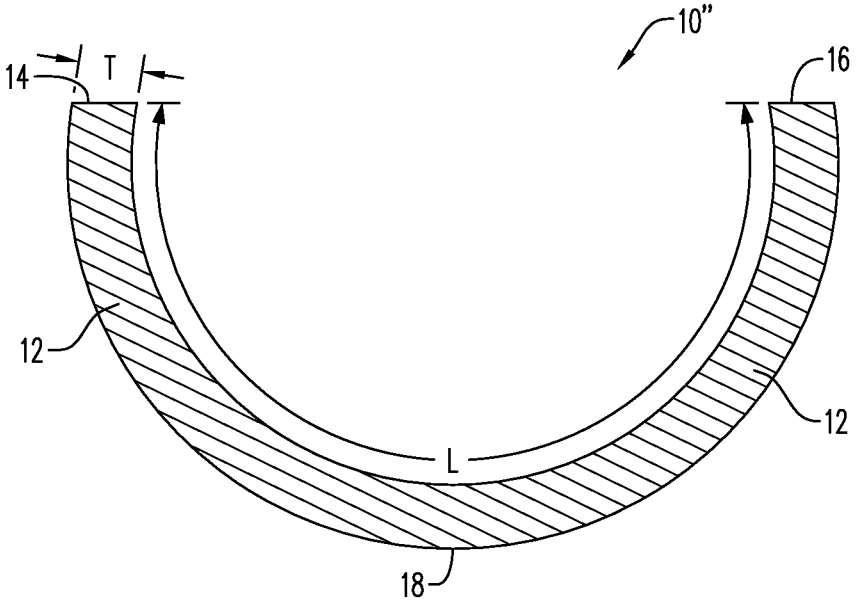
FIG. 1B is a cross-sectional view of a hemispherical shaped charge liner having a composition of metal powders, according to an embodiment.
Figure 1C:
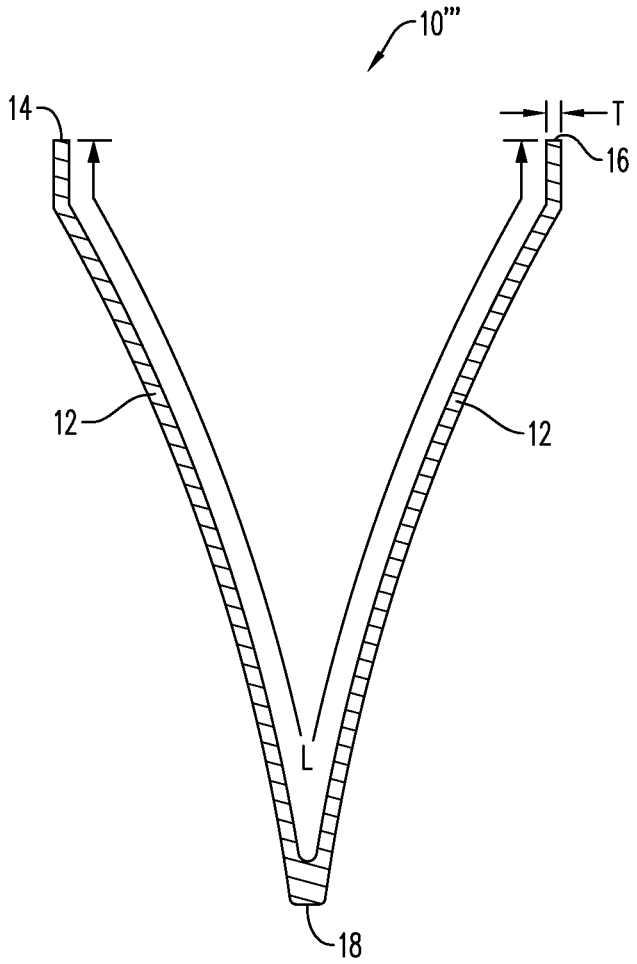
FIG. 1C is a cross-sectional view of a trumpet shaped charge liner having a composition of metal powders, according to an embodiment.
Figure 2:
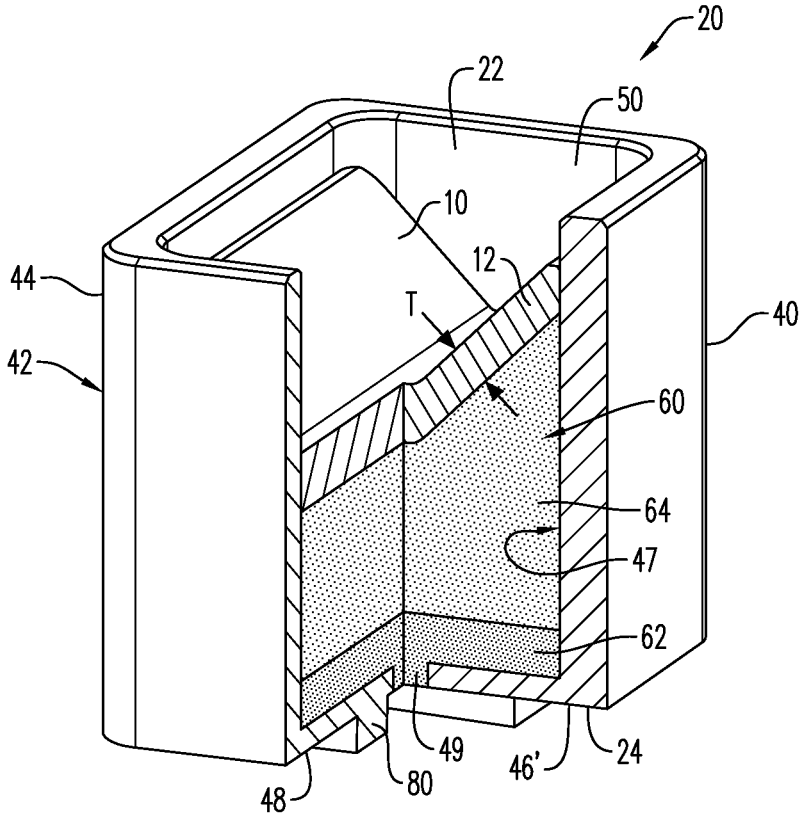
FIG. 2 is a partial cross-sectional, perspective view of a slot shaped charge having a shaped charge liner, according to an embodiment.
Figure 3:
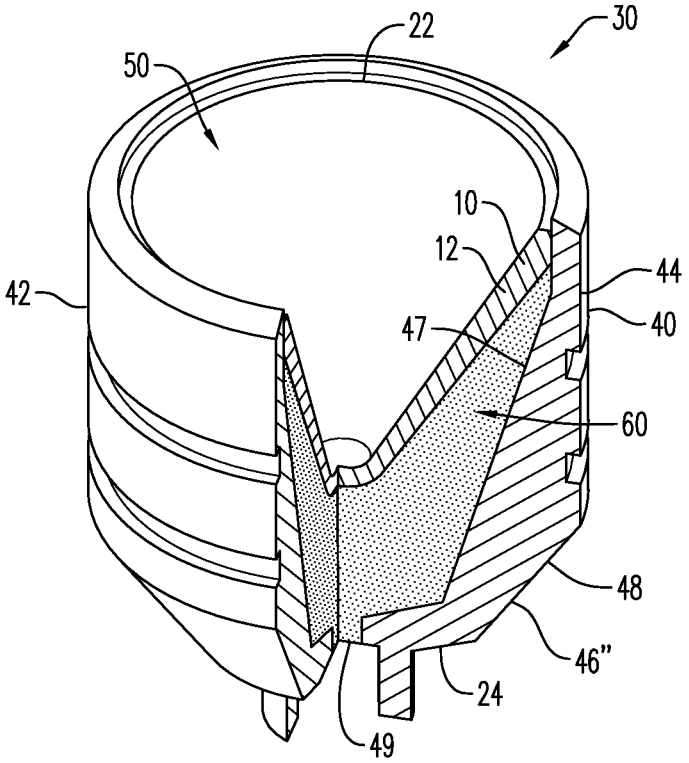
FIG. 3 is a perspective view of a conical shaped charge having a shaped charge liner, according to an embodiment.

In the illustrative examples and as seen in FIGS. 1A-3, a liner 10/10'/10"/10'" (generally "10") for use in a shaped charge 20, 30 is illustrated. As illustrated in FIGS. 2-3, the shaped charge 20, 30 may include a case/shell 40 having a plurality of walls 42. The plurality of walls may include a side wall 44 and a back wall 46', 46", that together define a hollow interior/cavity 50 within the case 40. The case 40 includes an inner surface 47 and an outer surface 48. An explosive load 60 may be positioned within the hollow interior 50 of the case 40, along at least a portion of the inner surface 47 of the shaped charge case 40. According to an aspect, the liner 10 is disposed adjacent the explosive load 60, so that the explosive load 60 is disposed adjacent the side walls 44 and the back walls 46', 46" of the case 40. The shaped charges 20, 30 have an open end 22, through which a jet is eventually directed, and a back end (closed end) 24, which is typically in communication with a detonating cord 70.

The liner 10 may have a variety of shapes, including conical shaped (e.g., liner 10') as shown in FIG. 1A, hemispherical or bowl-shaped (e.g., liner 10") as shown in FIG. 1B, or trumpet shaped (e.g., liner 10'") as shown in FIG. 1C. To be sure, the liner 10 may have any desired shape, which may include shapes other than those referenced herein.

The composition 12 of the liner 10 may be substantially uniform when measured at one or more positions along the length of the liner 10. For instance, a measurement of the constituents (i.e., the types of powders and the grain sizes of each powder) of the liner 10 taken at a first end 14 of the liner 10 may be identical to another measurement of the constituents of the liner 10 taken at a second end 16 of the liner 10. In an embodiment, an apex 18 (i.e., a midpoint between the first and second ends 14, 16) of the liner 10 includes constituents that are identical to the constituents of at least one of the first and second ends 14, 16. It is contemplated that the constituents of the first and second ends 14, 16 may be substantially identical, while the constituents at the apex 18 may be dissimilar to the constituents at the first and second ends 14, 16 of the liner 10.

The shaped charge liner 10 may generally have a thickness T/T1/T2 (generally "T") ranging from between about 0.5 mm to about 5.0 mm, as measured along its length. As illustrated in FIGS. 1A and 1B, the thickness T is uniform along the liner length L. In an alternative embodiment and as illustrated in FIG. 3, the thickness T varies along the liner length L, such as by having a thickness T2 that is larger/greater closer to the walls of the case 40 and a thickness T1 that is decreases or gets thinner closer to the center of the shaped charge 20, 30 (or apex 18 of the liner). Further, in one embodiment, the liner 10 (e.g., liner 10') may extend across the full diameter of the cavity 50 as shown in FIGS. 1A-1C. In an alternative embodiment (not shown), the liner 10'/10"/10'" may extend only partially across the diameter of the cavity 50, such that it does not completely cover the explosive load 60.

Additionally, the composition of the illustrative liners 10, as seen for instance in FIGS. 1A-1C, may be formed as a single layer (as shown). In an alternative embodiment, the liner 10' may have multiple layers (not shown). An example of a multiple-layered liner is disclosed in U.S. Pat. No. 8,156,871, which is hereby incorporated by reference to the extent that it is consistent with the disclosure.

According to an aspect, the shaped charge liner 10 is generally formed from a composition 12 of powders 14. The powders may be formed by any powder production techniques, such as, for example, grinding, crushing, atomization, and various chemical reactions. Each powder 14 in the composition 12 may be a powdered pure metal or a metal alloy. The powders 14 are each present in an amount that is less than 40% w/w of a total weight of the powders 14 in the composition 12. In an embodiment, the composition 12 is a blended mixture of metal powders. The blended mixture of metal powders may have a bulk density of up to about 11 $g/cm^3$. In an embodiment, the bulk density of all the blended powders in the composition is about 8 $g/cm^3$, alternatively about 6 $g/cm^3$. In an embodiment, the bulk density is from about 4 $g/cm^3$ to about 5 $g/cm^3$.

According to an aspect, the composition 12 includes two or more transition metal powders, one or more non-transition metal powders, and a bronze metal powder. Each powder of the transition metal powders, the non-transition metal powder, and the bronze metal powder is present in the composition 12 in an amount that is less than 40% w/w of a total weight of the powders 14 in the composition 12. Each transition metal powder may be about 5% w/w to about 20% w/w of the total weight of the composition 12, alternatively about 10% w/w to about 20% w/w of the total weight of the composition 12. Each non-transition metal powder may be about 5% w/w to about 39% w/w of the total weight of the composition 12. In an embodiment, the ratio of the transition metal powders to the non-transition metal powders is about 1:3. For instance, the transition metal powders may be about 10% w/w of a total weight of the composition 12, while the non-transition metal powders is about 30% w/w of the total weight of the composition 12. The ratio of the bronze metal powder to the non-transition metal powders may be about 1:1. For example, the bronze metal powder is about 39% w/w of the total weight of the composition, while the non-transition metal powders is also about 39% w/w of the total weight of the composition. Each type of powder may include a grain size that is the same as or different from the grain size of another powder. For example, the bronze metal powder may include a grain size of greater than 75 micrometers to about 100 micrometers, while one of the transition metal powders includes a grain size of greater than 125 micrometers to about 150 micrometers. The differences in the grain sizes of the powders 14 in the composition 12 may help facilitate a uniform/homogenous mixture of the powders (and in particular, of the metal powders) throughout the liner structure, which may aid in improving the high velocity/energy jet formed by the liner 10 upon detonation of the shaped charge 20, 30.

In an embodiment, the two or more transition metal powders and the one or more non-transition metal powders include one or more different grain sizes. The bronze metal powder includes two or more grain sizes. The use of different grain sizes in the composition 12 helps to increase consolidation of the metal powders, increase uniformity/homogeneity of the resultant composition 12 following mixture and compression, and ultimately enhance jet formation of the shaped charge liner 10. Such homogeneity within the liner composition may also produce a more uniform hydrodynamic jet upon detonation of the shaped charge 20/30. The distribution of the grain sizes in the liner 10 may also help facilitate a consistent collapse process of the liner 10, thereby helping to enhance performance of the shaped charges 20, 30 within which they are used. In an embodiment, the thermal energy formed upon detonation of the shaped charges 20, 30 may melt some of the powders of the composition 12, and/or at least reduce internal stress in the individual grains of the powders, which may also improve jet formation and enhance its uniformity. Additionally, the different grain sizes utilized may also increase/improve the density and decrease the porosity of the liner 10.

It is contemplated that the transition metals include one or more grain sizes, such as grain sizes greater than 0 micrometers up to about 75 micrometers, greater than 75 micrometers to about 100 micrometers, greater than 100 micrometers to about 125 micrometers, greater than 125 micrometers to about 150 micrometers, greater than 150 micrometers to about 200 micrometers, and greater than 200 micrometers to about 250 micrometers. The transition metal powder may include any highly electronegative metal. Such metals chemically bond with each other, as well as other metals 14 within the composition 12. In an embodiment, the two or more transition metal powders includes at least one of copper, nickel, molybdenum, tungsten, titanium, and iron. When the two or more transition metal powders includes nickel, the nickel includes at least one grain size, which may be one of greater than 0 micrometers up to about 75 micrometers, greater than 75 micrometers to about 100 micrometers, and greater than 100 micrometers to about 150 micrometers.

In an embodiment, the one or more non-transition metal powders include one or more grain sizes. Such grain sizes may be one of greater than 0 micrometers up to about 50 micrometers, greater than 50 micrometers to about 75 micrometers, greater than 75 micrometers to about 125 micrometers, greater than 125 micrometers to about 150 micrometers, greater than 150 micrometers to about 200 micrometers, and greater than 200 micrometers to about 300 micrometers. In an embodiment, the non-transition metal powder includes at least one of aluminum, lead, and tin.

When the one or more non-transition metal powders includes lead, the lead has two or more different grain sizes. Such grain sizes may be one of greater than 0 micrometers up to about 50 micrometers, greater than 50 micrometers to about 75 micrometers, greater than 75 micrometers to about 125 micrometers, greater than 125 micrometers to about 150 micrometers, and greater than 150 micrometers to about 300 micrometers. The lead metal powder may include a first grain size, and a second grain size that is different from the first grain size. The first grain size may be selected from the group comprising greater than 0 micrometers up to about 50 micrometers, greater than 50 micrometers to about 75 micrometers, and greater than 75 micrometers to about 125 micrometers, while the second grain sizes is from about 150 micrometers to about 300 micrometers. The ratio of the first grain size to the second grain size is about 1:1, with each of the grain sizes being thoroughly and uniformly dispersed within the composition 12. For example, the first grain size may be about 19% w/w of the total weight of the composition, while the second grain size is also about 19% w/w of the total weight of the composition.

When the one or more non-transition metal powder includes aluminum, the aluminum is about 3% to about 10% w/w of the total weight of the composition 12. The aluminum includes at least one grain size, which may be one of greater than 0 micrometers up to about 50 micrometers, greater than 50 micrometers to about 75 micrometers, greater than 75 micrometers to about 125 micrometers, and greater than 125 micrometers to about 150 micrometers.

The bronze metal powder may be up to about 39% w/w of the total weight of the composition 12. The bronze metal powder may include two or more different grain sizes. The grain sizes may be one of greater than 75 micrometers to about 100 micrometers, greater than 100 micrometers to about 125 micrometers, greater than 125 micrometers to about 150 micrometers, greater than 150 micrometers to about 200 micrometers, and greater than 150 micrometers to about 300 micrometers. In an embodiment, the bronze metal powder has three grain sizes. The first grain size is greater than 150 micrometers to about 200 micrometers, the second grain size is greater than 125 micrometers to about 150 micrometers, and the third grain size is greater than 100 micrometers to about 125 micrometers. When the first and second grain sizes are combined, the ratio of the third grain size to the combined first and second grain sizes is about 1:3. For example, the first grain size may be about 18% w/w of the total weight of the composition, while each of the second and third grain sizes is about 9% w/w of the total weight of the composition.

Embodiments of the disclosure are further directed to a shaped charge liner 10 including a composition 12 of powders 14. The composition 12 includes a plurality of malleable binding metal powders and a non-malleable metal powder. As used herein, the term "malleable" refers to a material that bends/deforms upon the application of compressive forces, such as stamping, hammering, forging, pressing, or rolling into thin sheets/strips, without breaking, cracking, or otherwise developing physical/structural defects. According to an aspect, the malleable binding metal powders includes one or more of copper, lead, iron, tin, aluminum, zinc, and the like. The non-malleable metal powder may include one or more of nickel, steel, iron, tungsten, titanium, molybdenum, and the like. The malleable binding metal powders and the non-malleable metal powder may be formed by any known powder forming process, such as those described hereinabove in relation to the transition and non-transition metal powders.

The composition 12 is a blended mixture of the malleable and non-malleable metal powders. Each malleable binding metal powder and non-malleable metal powder may be selected based on its ability to exothermically react with the other powders in the composition 12. Each of the malleable binding metal powders and the non-malleable metal powder of the composition 12 is present in an amount that is less than 40% w/w of a total weight of the powders 14 in the composition 12, alternatively about 5% w/w to about 39% w/w of the total weight of the composition 12. In an embodiment, each malleable binding metal powder is about 5% to about 20% of a total weight of the composition 12, while each non-malleable metal powder is about 5% to about 39% w/w of the total weight of the composition 12. Each malleable binding metal powder may be about 10% to about 20% of the total weight of the composition 12. While each powder 14 of the composition 12 may have different bulk densities, when blended, the metal powders collectively have a bulk density of up to about 11 $g/cm^3$. In an embodiment, the bulk density of all the blended powders in the composition is about 8 $g/cm^3$, alternatively about 6 $g/cm^3$. In an embodiment, the bulk density is from about 4 $g/cm^3$ to about 5 $g/cm^3$. When the malleable and non-malleable binding powders are compressed together to form the liner 10, the compressed powders have a pressed density of up to about 10 $g/cm^3$.

Each malleable binding metal powder, and each non-malleable metal powder, includes powders having distinct grain sizes. The malleable binding metal powder may include a grain size that is the same as or different from the grain size of one or more of the non-malleable metal powder. For example, one malleable binding metal powder may include two grain sizes of greater than 125 micrometers to about 150 micrometers and greater than 200 micrometers to about 250 micrometers, while one non-malleable metal powder has a grain size of greater than 0 micrometers up to about 75 micrometers. Alternatively, at least one of the malleable binding metal powders may include grain sizes that are the same as the grain size range of one non-malleable metal powder. In both instances, the different grain sizes help facilitate the combinability and an even distribution of the powders 14 in the composition 12. When evenly distributed, the powders are more densely compacted, and results in a liner that is able to create a perforation tunnel having a more even/uniform distribution, thus enhancing the flow characteristics of fluid or gas into the wellbore.

The malleable binding metal powders includes one or more different grain sizes. Such grain sizes may be provided in various amounts (i.e., a non-zero amount), and may be one of greater than 0 micrometers up to about 75 micrometers, greater than 75 micrometers to about 100 micrometers, greater than 100 micrometers to about 125 micrometers, greater than 125 micrometers to about 150 micrometers, greater than 150 micrometers to about 200 micrometers, greater than 200 micrometers to about 250 micrometers, and greater than 250 micrometers to about 300 micrometers.

The malleable binding metal powder includes a bronze metal powder. The bronze metal powder includes two or more different grain size ranges, such as, grain sizes that are one of greater than 75 micrometers to about 100 micrometers, greater than 100 micrometers to about 125 micrometers, greater than 125 micrometers to about 150 micrometers, and greater than 150 micrometers to about 200 micrometers. In an embodiment, the bronze metal powder includes three grain sizes, namely a first grain size greater than 150 micrometers to about 200 micrometers, a second grain size greater than 125 micrometers to about 150 micrometers, and a third grain size greater than 100 micrometers to about 125 micrometers. When the first and second grain sizes are combined, the ratio of the third grain size to the first and second grain sizes of the bronze metal powder is about 1:3. In other words, about 50% of the first grain size of the bronze metal powder is greater than 150 micrometers to about 200 micrometers, about 25% is greater than 125 micrometers to about 150 micrometers, and about 25% is greater than 100 micrometers to about 125 micrometers. For example, the first grain size may be about 19% w/w of the total weight of the composition, while each of the second and third grain sizes is about 9.5% w/w of the total weight of the composition. To be sure, the bronze metal powder may alternatively include four or more grain sizes, and alternatively five or more grain sizes. The different grain size ranges of the bronze powder may help ensure that the bronze powder is homogenously mixed together, as well as within the composition 12. While grain sizes have been provided hereinabove for the bronze metal powder, the grain sizes of the bronze powder may be selected based on the other powders 14 in the composition 12, as well as based on the needs of the particular application.

In an embodiment, the plurality of malleable binding metal powders includes one or more different types of powders. When the malleable binding metal powders includes more than one type of powder, such as, for example, titanium and aluminum, the titanium powder may have grain sizes that are different from the grain sizes of aluminum. Alternatively, the titanium may include two or more different grain size ranges, at least one of which may be the same as a grain size range of the aluminum.

According to an aspect, when the malleable binding metal powders include lead, the lead may include two grain sizes. The ratio of the first grain size to the second grain size may be about 1:1. For example, the first grain size may be about 19% w/w of the total weight of the composition, while the second grain size is also about 19% w/w of the total weight of the composition 12. The first grain size of the lead metal powder may be greater than 0 micrometers to about 125 micrometers, while the second grain size may be from about 150 micrometers to about 300 micrometers.

In an embodiment, the non-malleable metal powder includes one or more different grain sizes. The grain sizes may be one of greater than 0 micrometers up to about 50 micrometers, greater than 50 micrometers to about 75 micrometers, greater than 75 micrometers to about 125 micrometers, and greater than 125 micrometers to about 150 micrometers. When the non-malleable metal powder includes nickel, the nickel metal powder may be between 5% and 25% w/w of the total weight of the composition 12, and may include at least one grain size that is one of greater than 0 micrometers up to about 50 micrometers, greater than 50 micrometers to about 75 micrometers, and greater than 75 micrometers to about 125 micrometers.

Embodiments of the present disclosure are further directed to a shaped charge liner 10 that includes a composition 12 of metal powders 14. The metal powders 14 are selected to ensure that the liner 10 is capable of generating an exothermic reaction, and each is present in the composition 12 in less than about 40% w/w of a total weight of the composition 12. Each metal powder 14 is selected based on the properties of the metal, and includes at least one grain size that is selected to aid in facilitating the uniformity of the composition 12, and in some instances the uniformity of the liner 10. The composition 12 of metal powders 14 is a blended mixture comprising a bulk density of up to about 11 $g/cm^3$. In an embodiment, the bulk density of all the blended powders in the composition is about 8 $g/cm^3$, alternatively about 6 $g/cm^3$. In an embodiment, the bulk density is from about 4 $g/cm^3$ to about 5 $g/cm^3$.

The plurality of metal powders 14 includes a bronze metal powder present in an amount up to 39% w/w of the total weight of the composition 12, and having two or more grain sizes. The grain sizes may be one of greater than 75 micrometers to about 100 micrometers, greater than 100 micrometers to about 125 micrometers, greater than 125 micrometers to about 150 micrometers, greater than 150 micrometers to about 200 micrometers, and greater than 200 micrometers to about 250 micrometers. According to an aspect, the bronze metal powder includes three or more grain sizes, alternatively four or more of the different grain sizes, and alternatively five grain sizes. Each grain size may be selected from the grain sizes referenced hereinabove, so that the bronze metal powder collectively includes grain sizes between greater than 0 micrometers to about 250 micrometers. To be sure, the bronze metal powder may include grain sizes not described herein, so long as the grain sizes aid in facilitating a homogenous liner composition.

The bronze metal powder may include three grain sizes. The first grain size is greater than 150 micrometers to about 200 micrometers, the second grain size is greater than 125 micrometers to about 150 micrometers, and the third grain size is greater than 100 micrometers to about 100 micrometers. As described hereinabove, when the first and second grain sizes are combined, the ratio of the third grain size to the first and second grain sizes of the bronze metal powder is about 1:3. In this configuration, if 15% w/w of the total weight of the composition 12 is the first grain size, the second and third grain sizes are each 7.5% w/w of the total weight of the composition 12.

In an embodiment, the metal powders 14 include a lead metal powder. In this embodiment, the lead metal powder is similar to the lead metal powder described hereinabove. Thus, for purposes of convenience and not limitation, the various features, attributes and properties of the lead metal powder discussed above are not repeated here.

In an embodiment, the lead metal powder is present in an amount up to 39% w/w, alternatively 5% w/w to about 39% w/w of the total weight of the composition 12. The lead metal powder includes multiple grain sizes. The lead metal powder may include two grain sizes (i.e., a first grain size and a second grain size). The ratio of the first grain size to the second grain size of the lead metal powder may be about 1:1, with each grain size being similar to those of the lead metal powder described hereinabove. In at least an embodiment, there is no overlap between the first and second grain sizes of the lead metal powder. According to an aspect, the lead metal powder includes three of more grain size, each grain size being selected from those of the aforementioned first and second grain sizes.

The metal powders 14 include an aluminum metal powder. As compared to the bronze and lead metal powders, the aluminum metal powder is up to about 10% w/w of the total weight of the composition 12. In an embodiment, the aluminum metal powder is about 5% to about 10% w/w of the total weight of the composition 12. The aluminum metal powder may include several grain sizes, namely, two or more grain sizes that are one of greater than 0 micrometers up to about 50 micrometers, greater than 50 micrometers to about 75 micrometers, greater than 75 micrometers to about 125 micrometers, and greater than 125 micrometers to about 150 micrometers.

The metal powders 14 further include a nickel metal powder present in about 10% to about 25% w/w of the total weight of the composition 12. In an embodiment, the nickel metal powder is present in an amount up to about 20% w/w of the total weight of the composition 12. Similar to the other metal powders 14 described hereinabove, the nickel metal powder may include a grain size that is one of greater than 50 micrometers to about 75 micrometers, greater than 75 micrometers to about 125 micrometers, and greater than 125 micrometers to about 150 micrometers.

According to an aspect, the composition 12 includes at least one of molybdenum, tungsten, titanium, and iron. Each may include one or more different grain sizes to further aid in the combinability of the powders in the composition 12.

While the composition 12 includes metal powders 14, it may further include a nonmetal powder. Similar to the metal powders, in an embodiment, the non-metal powder is present in an amount less than 40% w/w of a total weight of the composition 12. The non-metal powder includes distinct grain sizes.

According to an aspect, the composition 12 includes at least one of a binder and a lubricant material, each being evenly dispersed within the composition 12. According to an aspect, the binder and lubricant enhances processability of the powders in the composition 12. The binder and lubricant may help with the efficient mixing and distribution of the different metal and nonmetal powders in the composition 12. They may help prevent the formation of lumps in the composition 12, so that the liner 10 has the same properties along any portion of its length L and thickness T. The binder may be formed of the aforementioned lead metal powder, and may be present in the aforementioned quantities. It is contemplated that suitable binders may include a polymer resin or powder, wax and the like. According to an aspect, the binder can also be an oil-based material or soft metals, such as lead and copper. According to an aspect, a graphite powder or oil-based material may function as the lubricant. The lubricant is present in an amount up to about 1.5% w/w of the total weight of the composition 12, and helps to bind one or more of the powders in the composition 12 having low grain sizes, so that during the mixing process, the risk of loss of powders due to their fineness or low granularity and/or potential contamination of the work environment is reduced. When the shaped charge liner 10 includes the oil-based material, the material helps prevent oxidation of the liner 10. The oil-based material, even when present in trace amounts, aids with thorough blending/mixing of the powders (having various grain sizes) of the composition 12.

Embodiments of the liners of the present disclosure may be used in a variety of shaped charges 20, 30, which incorporate the above-described shaped charge liners 10. As noted, the shaped charge of FIG. 2 is a slot shaped charge 20, having an open end 22, and a closed end 24 formed in its flat back wall 46'. In contrast, the shaped charge of FIG. 3 is a conical shaped charge having an open end 22, and a conical shaped back wall 46". The shaped charges are detonated via a detonation cord 70 that is adjacent an area of the back walls 46', 46" and is in communication with an explosive load positioned within a cavity (hollow interior) of the shaped charge.

FIGS. 2-3 illustrate the shaped charges 20, 30 including a case 40 defining a cavity 50. According to an aspect, the shaped charges 20, 30 include an explosive load 60 disposed within the cavity 50 of the case 40. A shaped charge liner 10 may be disposed adjacent the explosive load 60, thus retaining the explosive load 60 within the cavity 50 of the case 40. The liner 10, while shown in a conical configuration 10' in the shaped charges of FIGS. 2-3, may also be present in a hemispherical configuration 10" as shown in FIG. 1B. To be sure, the liners 10 described hereinabove may be utilized in any shaped charge. The liner 10 may include a composition 12 that includes metal powders. Therefore, the shaped charge liners 10 of the present disclosure may serve multiple purposes, such as, to maintain the explosive load 60 in place until detonation, and to accentuate the explosive effect on the surrounding geological formation.

For purposes of convenience, and not limitation, the general characteristics of the shaped charge liner 10 are described above with respect to the FIGS. 1A-1C, and are not repeated here.

While there are numerous grain sizes that can be used for each shaped charge liner 10, it has been found that the aforementioned grain sizes help provide a more homogenous mixture of the powders in the composition 12, thus enhancing the shaped charge liner's 10 ability to create a reproducible high-energy output or jet velocity upon detonation of the shaped charge 20, 30.

Further, the composition 12 utilized may help the liner 10 produce energies through chemical and/or intermetallic reactions between two or more of the powders and components. Such reactions may also occur between one or more of the constituents of the composition 12, and portions of the surrounding formation (such as, the wellbore fluid and/or formation fluids). The reactions may include exothermic reactions between two or more of the powders. The reactions may occur at a temperature of about 400° C. to about 700° C., or at relatively low temperatures, and may help to produce additional energy, that is, energy that is not formed by the activation of the explosive loads 60 of the shaped charge 20, 30. The additional energy may raise the total energy of the shaped charge liner 10 to a temperature level that helps facilitate a second reaction within the perforation tunnel. This second reaction may be an exothermic reaction and an intermetallic reaction that produces less, the same, or more energy than the initial explosion that forms the perforating jet. In other words, the second reaction may require a higher ignition temperature, but the end result may be a more consistent collapse of the liner 10, which leads to more reliability of the performance of the shaped charges 20, 30.

Typical reactions may be formed according to the data presented in a technical report titled "Incendiary Potential of Exothermic Intermetallic Reactions" prepared by Lockheed Palo Alto Research Laboratory, designated as Technical Report AFATL-TR-71-87, and dated July 1971. Without intending to be bound by the theory, it is also contemplated that additional reactions may occur between three or more of the powders of the composition 12, such as, for example, between copper, aluminum and titanium, and between copper, titanium and carbon.

The composition 12 of the liners 10 undergo an exothermic reaction, which may occur even at lower energies, such as in the shaped charges 20, 30, including when a small or decreased amount of explosive materials, or lower energy explosive materials, is used in the explosive load 60. As illustrated in FIG. 2, and according to an aspect, the explosive load 60 utilized in the shaped charges 20, 30 may include a primary explosive load 62 and a secondary explosive load 64. The primary explosive load 62 may be positioned between the secondary explosive load 64 and the back wall 46' of the shaped charge 20, adjacent an initiation point 49 arranged at the back wall 46'. Alternatively, as illustrated in FIG. 3, the explosive load 60 is a single layer of explosive material adjacent the initiation point 49. While FIGS. 2 and 3 each illustrate a single initiation point 49, it is envisioned that two of more initiation points 49 may be provided in the shaped charge 20, 30. A detonating cord 70 (optionally aligned by guiding members 80), may be adjacent the initiation point. While not illustrated in the conical shaped charge 30 of FIG. 3, it is contemplated that such conical shaped charges may also include primary and secondary explosive loads 62, 64, as the application may require.

Figure 4:
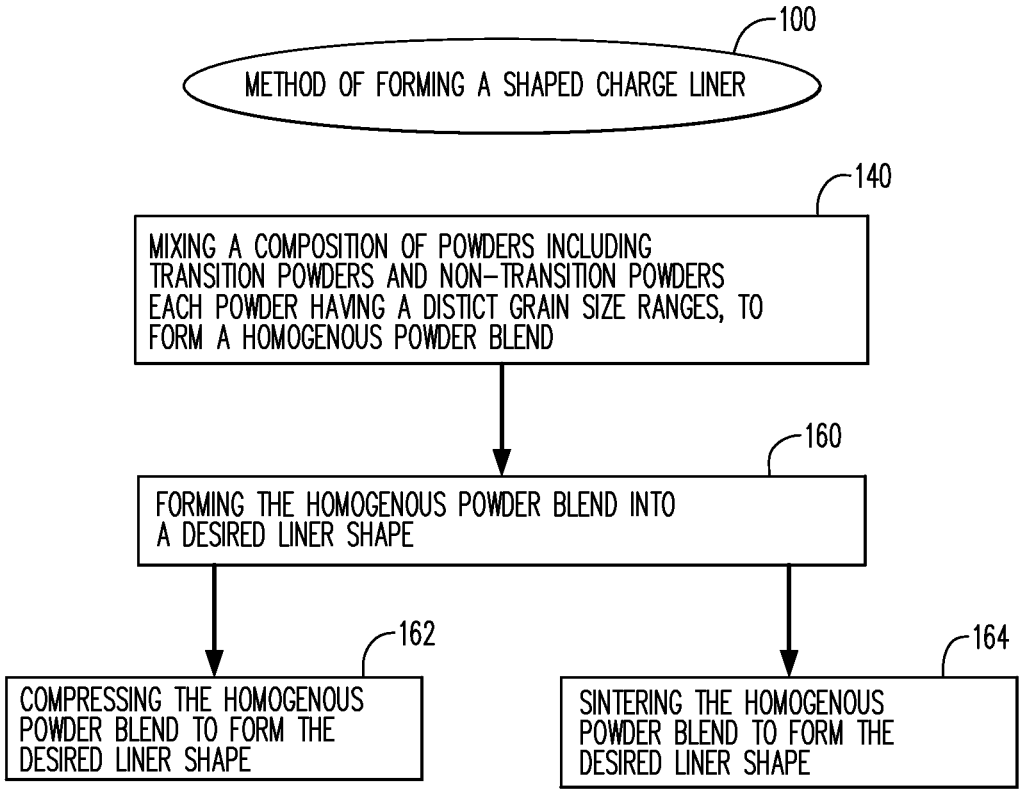
FIG. 4 is a flow chart illustrating a method of forming a shaped charge liner, according to an embodiment.

Turning now to FIG. 4, a method 100 of forming a shaped charge liner is illustrated. The method 100 includes mixing 140 a composition of powders to form a powder blend. The composition of powders may include any of the compositions described hereinabove, such as, the transition metal powders, the non-transition metal powders and the bronze metal powder. In an embodiment, the composition includes the malleable binding metal powders and the non-metal binding powders. Each metal powder may be present in an amount that is less than 40% w/w of a total weight of the composition. Each powder may include one or more grain sizes, and in some embodiments, two of more grain sizes. The transition and non-transition metal powders, the bronze metal powder, and the malleable binding metal powders and the non-malleable metal powders utilized are substantially as described hereinabove, and thus, their features are not described here. The grain sizes of the powders are particularly key in the mixing 140 step, as the selected grain sizes help to form the powder blend, which may be a homogenous powder blend. A mixer is used to thoroughly mix the powders, and may mix the powders at a speed of about 2 revolution/second (revs/sec) to about 4,000 revs/sec, alternatively between about 1,000 rev/sec and 3,000 revs/sec, and alternatively between about 2 revs/sec to about 2,000 revs/sec. Once mixed, the homogenous powder blend is formed 160 into a desired liner shape, such as the conical shape shown in FIG. 1A, the hemispherical or bowl shape shown in FIG. 1B, or the trumpet shape shown in FIG. 1C. The liner shape may be formed by compressing 162 the powder blend using a force of up to about 1,500 kN. The powder blend may be sintered 164 to form the desired liner shape.

Figure 5:
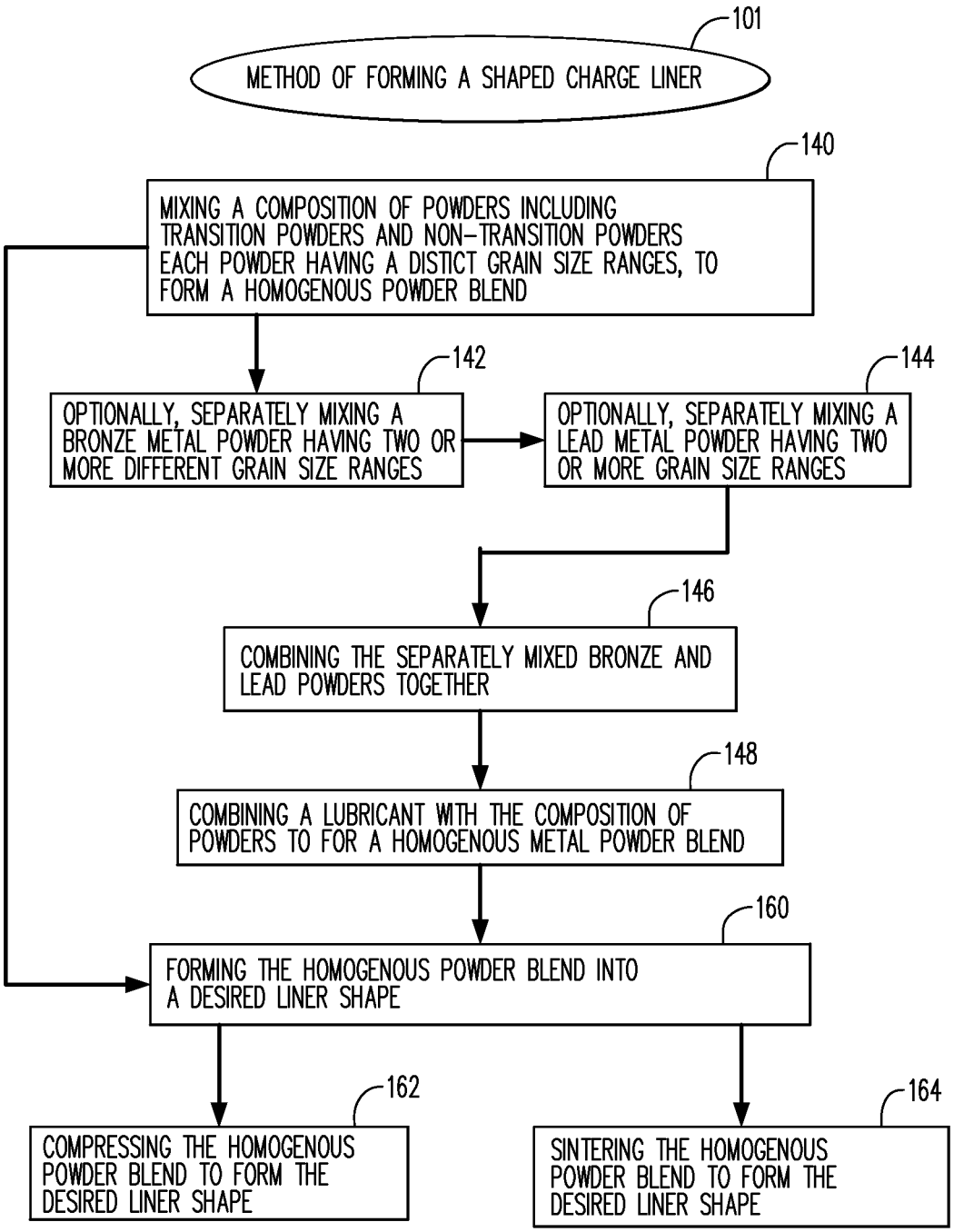
FIG. 5 is a flow chart illustrating a further method of forming a shaped charge liner, according to an embodiment.

FIG. 5 is a flow chart that illustrates a further method 101 of forming a shaped charge liner. As described hereinabove and illustrated in FIG. 4, a homogenous powder blend may be formed by mixing 140 a composition of powders, such as transition metal powders, non-transition metal powders, a bronze metal powder, malleable binding metal powders, and non-malleable metal powders. The powders may include grain sizes that, along with the mixing steps, help to form a homogenous powder blend. The powder blend is thereafter formed 160 into the desired liner shape. When any type of powder includes two or more grain sizes, the powder may be mixed so that the grain sizes are combined with each other. For example, when the bronze metal powder includes two or more grain sizes, the method 101 includes separately mixing 142 the bronze metal powder so that all its grain sizes are combined together. Similarly when the composition includes a lead metal powder including two or more grain sizes, the lead metal powder including the two or more grain sizes is also separately mixed 144. The separately mixed bronze metal powder and the separately mixed lead metal powder are thereafter combined 166, and then all the powders of the composition are mixed 140 together. In an embodiment, the method 101 includes combining 148 a binder and a lubricant material with the composition, prior to forming 160 the desired liner shape. The liner may be formed into the desired liner shape by compressing 162 the homogenous powder blend or sintering 164 the homogenous powder blend.

Figure 6:
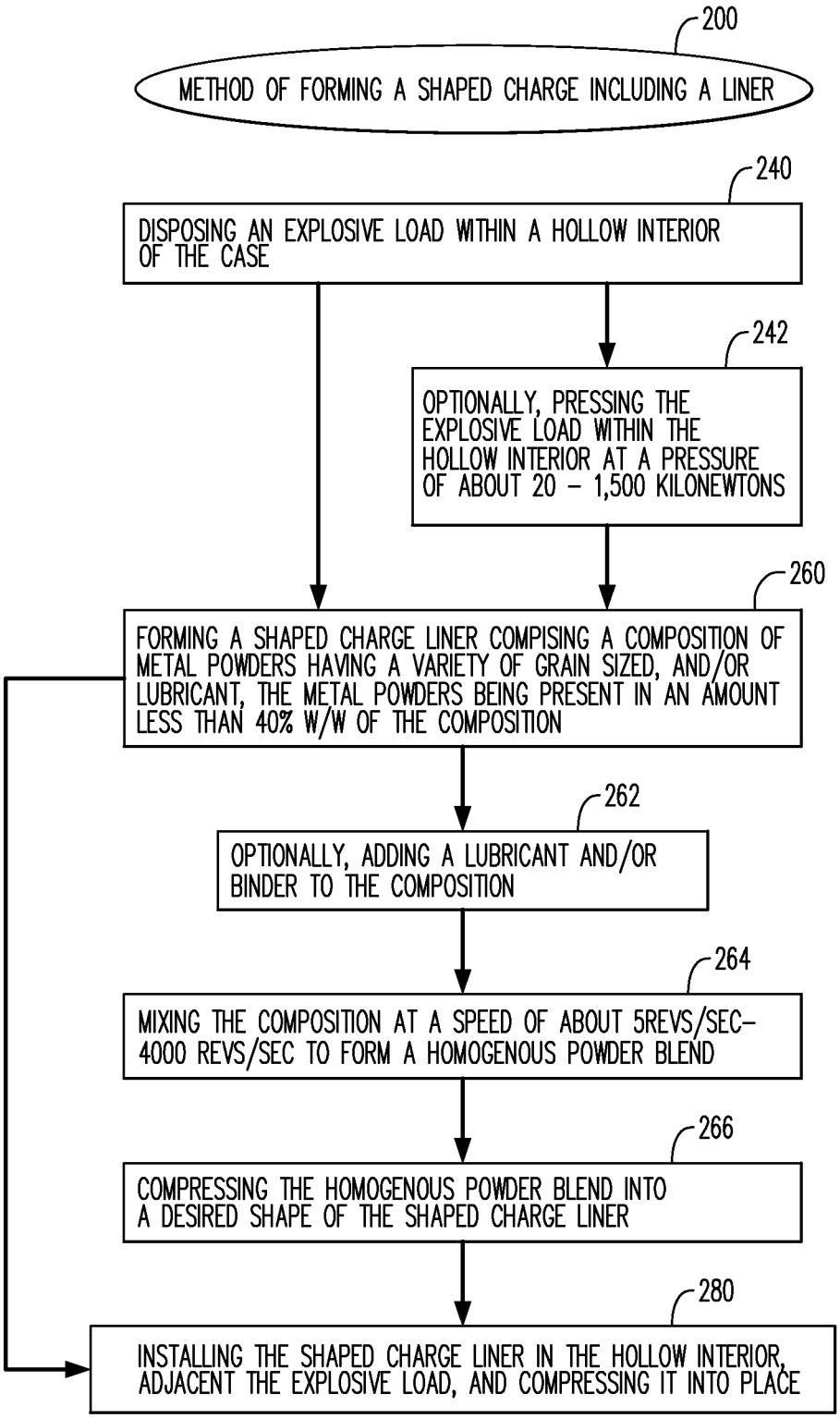
FIG. 6 is a flow chart illustrating a method of forming a shaped charge including a shaped charge liner, according to an embodiment.

Embodiments of the disclosure further describe a method 200 of forming a shaped charge including any of the above-described shaped charge liners. As illustrated in the flow chart of FIG. 6, the method 200 includes disposing an explosive load 240 within a hollow interior of a shaped charge case. In this configuration, the explosive load is adjacent a back wall, an initiation point, and at least a portion of a side wall of the shaped charge. The explosive load includes one or more explosive powders that are arranged within the hollow interior. The explosive powders may be loosely placed in the hollow interior. In an embodiment, the explosive load is pressed 242 within the hollow interior of the case at a force of between about 20 kN to about 1,000 kN, alternatively between about 30 kN to about 700 kN.

According to an aspect, the method 200 further includes providing a shaped charge liner including a composition of metal powders. Each metal powder is present in an amount less than 40% w/w of the composition, and includes one or more distinct grain sizes. The composition contemplated is substantially as described hereinabove with respect to the shaped charge liners 10 illustrated in FIGS. 1A-1C, and 2-3. The shaped charge liner may be formed 260 according to any of the methods 100/101 described hereinabove and illustrated in FIGS. 4-5. In an embodiment, the step of forming 260 the shaped charge liner includes adding 262 at least one of a lubricant and a binder to the composition, mixing 264 the composition including the lubricant and/or binder at a speed of between about 5 revs/sec to about 4,000 revs/sec to form a homogenous powder blend, and compressing 266 the powder blend into a desired liner shape. The shaped charge liner is installed 280 into the hollow interior of the case, adjacent the explosive load, so that the explosive load is secured within the hollow interior and is positioned between the back wall and the shaped charge liner. The shaped charge liner is installed so that it is adjacent the explosive load, and it may be compressed onto the explosive load, such that the explosive load is positioned between the back and side walls, and the shaped charge liner.

While the methods 100/101 of forming the shaped charge liner, and the method 200 of forming a shaped charge including a shaped charge liner describe a composition including transition and non-transition metal powders, to be sure, the composition may include malleable and non-malleable metal powders having the grain sizes, substantially as described hereinabove.

EXAMPLE 1

Various compositions 12 for use in shaped charge liners may be made according to the embodiments of the disclosure. The percentages presented in the Example shown in Table 1 are based on the total % w/w of the powders in the composition 12 and exclude reference to de minimis amounts of processing oils or lubricants that may be utilized. Such oils or lubricants may be present in a final mix in an amount of between about 0.01% and 1% of the total % w/w of the powders in the composition 12. The composition 12 may include the following powder components, each component having a selected grain size.

TABLE 1

| Shaped Charge Liner - Sample Composition | Grain Size (s) Minimum Grain Size (micrometers (μm)) | Maximum Grain Size (micrometers (μm)) | Liner Blend (%) w/w |
|---|---|---|---|
| Transition Metal 1 | >0 | 75 | 5-20 |
| Transition Metal 2 | >75 | 100 | 5-20 |
| Non-transition Metal 1 | >0 | 50 | 5-20 |
| Non-transition Metal 2 | >50 | 75 | 3-25 |
| Non-transition Metal 3 | >75 | 125 | 3-25 |
| Non-transition Metal 4 | >150 | 200 | 5-20 |
| Non-transition Metal 5 | >200 | 300 | 5-20 |
| Bronze 1 | >100 | 125 | 5-10 |
| Bronze 2 | >125 | 150 | 5-15 |
| Bronze 3 | >150 | 200 | 10-25 |

The composition 12 presented in Table 1—Sample Composition—may include two transition metal powders, two or more non-transition metal powders having up to five grain sizes, and a bronze metal powder. In at least an embodiment, the Sample Composition includes two or more grain sizes of the bronze metal powder. The Sample Composition may include one transition metal powder having two grain sizes, or two transition metal powders each having a different grain size. The non-transition metal powder may be provided in up to five grain sizes. In at least one embodiment, two non-transition metal powders are provided. The non-transition metals may include lead and aluminum. The lead metal powder may include grain sizes that overlap with grain sizes of the aluminum metal powder. The bronze metal powder may include multiple grain sizes, which may include one or more of >100 μm to about 125 μm, >125 μm to about 150 μm, and >150 μm to about 200 μm. Each grain size of the bronze metal powder may be provided in about 5% to about 25% w/w of the total weight of the composition 12.

Various powders may be utilized in the composition 12. For example, powders having a spherical shape/configuration, and powders having an irregular shape may be utilized. For the particular powders in the composition 12 having two or more grain sizes, in an embodiment, at least one grain size includes spherically shaped powders, while one or more of the other grain sizes/(s) include/(s) irregular shaped powders. For instance, bronze metal powders with grain sizes between >100 μm to about 125 μm may include irregular shaped powders, while bronze metal powders of grain sizes between >150 μm to 200 μm, may include spherically shaped powders.

Without being bound by theory, it is believed that there is synergy between grain sizes, and the % w/w for the powders of the composition 12. The grain size data presented in Table 1 was generated through extensive testing, and analysis of material specifications and data sheets, as may be measured by the measuring principle of dynamic image analysis ISO 13322-2 titled "Particle size analysis—Image analysis methods" and prepared by the Technical Committee ISO/TC 24. Although various grain sizes are provided for each type of powder, it is envisioned in an alternative embodiment that two or more of the powders may include identical grain sizes.

EXAMPLE 2

Sample shaped charges were generally configured to demonstrate the performance of shaped charges incorporating liners made according to embodiments described herein. Each shaped charge included a case/casing, and an initiation point formed in the back wall of the case. An explosive load was arranged within the hollow interior, and liners of different compositions and grain size s of powders were positioned adjacent the explosive load. A detonating cord was positioned adjacent the initiation point. The shaped charges were detonated, measurements of the entrance hole diameters and lengths of the perforation jets were taken, and productivity ratio evaluations were made. The values presented in Table 2 represent the results of the measurements taken and evaluations made upon detonation of the shaped charges.

Two sets of commercially available (or established liners) were utilized in samples B, D and E, the liners each including various powders. Samples A, and C, however, each included liners having at least one powder with two or more grain sizes, and at least one powder included a grain size that was different from the grain size of another powder. In samples A, and C, the liners included bronze having three grain sizes, lead having two grain sizes, and nickel and aluminum having one grain size.

TABLE 2

| Samples | Average Entrance Hole Diameter (millimeters (mm) | Average Stressed Rock Target Penetration (millimeters (mm)) | Productivity Ratio |
|---|---|---|---|
| A | 11.4 | 285 | 1.19 |
| B | 10.9 | 260 | 1.10 |
| C | 11.1 | 302 | 1.17 |
| D | 10.8 | 283 | 1.08 |
| E | 9.9 | 359 | 1.05 |

To obtain the data shown in Table 2, the shaped charges were tested in an API 19b Section IV set-up using steel casing coupons having a thickness of 0.5 inch. The steel coupons were positioned adjacent a cement/concrete sheath or layer having a thickness of 0.75 inch, and the cement sheath was adjacent a natural sandstone target having high strength and low porosity. The shaped charges were detonated so that a perforating jet penetrated the steel coupon, the concrete sheath and the sandstone target, and the perforation tunnel formed in the sandstone target and the productivity ratio were measured according to the API 19b Section Test requirements. The results in Table 2 indicate that increases in target penetration depth are not necessarily equivalent to increases in productivity ratio. On the other hand, the geometry of the perforating tunnel plays an important role in increasing productivity ratio. Notably, samples A and C showed improvements in productivity ratio over samples B, D and E. The results further indicate that the exothermic reaction of Samples A and C creates perforating tunnels, which provide a geometry that is conducive to favorable flow performance, as compared to Samples B, D and E.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiment" "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges there between. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the liner, the shaped charge including the liner, and the methods of making, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A shaped charge liner comprising:

a composition of powders, the composition comprising:

a plurality of malleable binding metal powders comprising bronze, and one or more of copper, lead, iron, tin, aluminum, and zinc, wherein the bronze metal powder comprises two or more grain sizes, the grain sizes comprising:

greater than 75 micrometers to about 100 micrometers;

greater than 100 micrometers to about 125 micrometers;

greater than 125 micrometers to about 150 micrometers; and greater than 150 micrometers to about 200 micrometers; and a non-malleable metal powder, wherein each of the malleable binding metal powders comprise one or more grain sizes, the grain sizes comprising:

greater than 0 micrometers up to about 75 micrometers;

greater than 75 micrometers to about 100 micrometers;

greater than 100 micrometers to about 125 micrometers;

greater than 125 micrometers to about 150 micrometers;

greater than 150 micrometers to about 200 micrometers;

greater than 200 micrometers to about 250 micrometers; and greater than 250 micrometers to about 300 micrometers; and the non-malleable metal powder comprises one or more grain sizes, the grain sizes comprising:

greater than 0 micrometers up to about 50 micrometers;

greater than 50 micrometers to about 75 micrometers;

greater than 75 micrometers to about 125 micrometers; and greater than 125 micrometers to about 150 micrometers.

2. The shaped charge liner of claim 1, wherein when the malleable binding metal powders comprise lead, the lead comprises:

a first grain size of from greater than 0 micrometers to about 125 micrometers; and a second grain size of from about 150 micrometers to about 300 micrometers, wherein the ratio of the first grain size to the second grain size is about 1:1.

3. The shaped charge liner of claim 1, wherein the non-malleable powder comprises nickel, steel, iron, tungsten, titanium, and molybdenum.

4. The shaped charge liner of claim 1, wherein the pressed density of the composition of powders is about 12 g/cm$^3$.

5. The shaped charge liner of claim 1, wherein:

each of the malleable binding metal powders is about 5% to about 20% w/w of a total weight of the composition; and the non-malleable metal powder is about from 5% w/w to about 39% w/w of a total weight of the composition.

6. A shaped charge comprising:

a case comprising a plurality of walls, the plurality of walls comprising a side wall and a back wall, the side and back walls defining a hollow interior within the case;

an explosive load disposed within the hollow interior;

a shaped charge liner disposed adjacent the explosive load and configured for retaining the explosive load within the hollow interior, the shaped charge liner comprising a composition of metal powders, wherein the composition comprises:

a bronze metal powder comprising two or more grain sizes, the grain sizes comprising greater than 75 micrometers to about 100 micrometers, greater than 100 micrometers to about 125 micrometers, greater than 125 micrometers to about 150 micrometers, greater than 150 micrometers to about 200 micrometers, and greater than 200 micrometers to about 250 micrometers;

a lead metal powder comprising one or more grain sizes, the grain sizes comprising greater than 0 micrometers up to about 75 micrometers, greater than 75 micrometers to about 100 micrometers, greater than 100 micrometers to about 125 micrometers, greater than 125 micrometers to about 150 micrometers, greater than 150 micrometers to about 200 micrometers, greater than 200 micrometers to about 250 micrometers, and greater than 250 micrometers to about 300 micrometers;

an aluminum metal powder comprising a grain size, wherein the grain size is one of greater than 0 micrometers up to about 50 micrometers, greater than 50 micrometers to about 75 micrometers, greater than 75 micrometers to about 125 micrometers, and greater than 125 micrometers to about 150 micrometers; and a first nickel metal powder and a second nickel powder, wherein each of the first nickel powder and the second nickel powder comprises a grain size greater than 50 micrometers to about 75 micrometers, greater than 75 micrometers to about 125 micrometers, and greater than 125 micrometers to about 150 micrometers, the grain size of the first nickel powder being different from the grain size of the second nickel powder, wherein each of the bronze metal powder, the lead metal powder, the aluminum metal powder and the first nickel powder and the second nickel powder is present in about 5% to about 39% w/w of a total weight of the metal powders in the composition.

7. The shaped charge of claim 6, wherein the bronze metal powder is present in about 39% w/w of the composition, and the bronze metal powder comprises three or more grain sizes, the grain sizes comprising:

greater than 75 micrometers to about 100 micrometers;

greater than 100 micrometers to about 125 micrometers;

greater than 125 micrometers to about 150 micrometers; and greater than 150 micrometers to about 200 micrometers.

8. The shaped charge of claim 6, wherein the bronze metal powder comprises:

a first grain size of greater than 150 micrometers to about 200 micrometers;

a second grain size of greater than 125 micrometers to about 150 micrometers; and a third grain size of greater than 100 micrometers to about 125 micrometers, wherein the first and second grain sizes are combined, and the ratio of the third grain size to the first and second grain sizes is about 1:3.

9. The shaped charge of claim 6, wherein the shaped charge liner further comprises at least one of a binder and a lubricant material, wherein:

the lubricant material is present in up to about 1.5% w/w of the total weight of the composition.

10. The shaped charge of claim 6, wherein the lead metal powder comprises:

a first grain size of greater than 0 micrometers to about 125 micrometers; and a second grain size of from about 150 micrometers to about 300 micrometers.

11. The shaped charge of claim 10, wherein the ratio of the first grain size to the second grain size of the lead metal powder is about 1:1.

12. A shaped charge liner comprising:

a composition of powders, the composition comprising:

a plurality of malleable binding metal powders comprising bronze, and one or more of copper, lead, iron, tin, aluminum, and zinc, wherein when the malleable binding metal powders comprise lead, the lead comprises:

a first grain size of from greater than 0 micrometers to about 125 micrometers; and a second grain size of from about 150 micrometers to about 300 micrometers, wherein the ratio of the first grain size to the second grain size is about 1:1; and a non-malleable metal powder, wherein each of the malleable binding metal powders comprise one or more grain sizes, the grain sizes comprising:

greater than 0 micrometers up to about 75 micrometers;

greater than 75 micrometers to about 100 micrometers;

greater than 100 micrometers to about 125 micrometers;

greater than 125 micrometers to about 150 micrometers;

greater than 150 micrometers to about 200 micrometers;

greater than 200 micrometers to about 250 micrometers; and greater than 250 micrometers to about 300 micrometers; and the non-malleable metal powder comprises one or more grain sizes, the grain sizes comprising:

greater than 0 micrometers up to about 50 micrometers;

greater than 50 micrometers to about 75 micrometers;

greater than 75 micrometers to about 125 micrometers; and greater than 125 micrometers to about 150 micrometers.

13. The shaped charge liner of claim 12, wherein the non-malleable powder comprises nickel, steel, iron, tungsten, titanium, and molybdenum.

14. The shaped charge liner of claim 13, wherein when the non-malleable powder comprises nickel, the nickel metal powder is present in about 5% to about 25% w/w of the total weight of the composition.

15. The shaped charge liner of claim 12, wherein the nickel comprises at least one grain size that is one of:

greater than 0 micrometers up to about 50 micrometers;

greater than 50 micrometers to about 75 micrometers; and greater than 75 micrometers to about 125 micrometers.

16. The shaped charge liner of claim 12, wherein the plurality of malleable binding metal powders and the non-malleable metal powder collectively have a bulk density of up to about 11 $g/cm^3$.

17. The shaped charge liner of claim 12, wherein the pressed density of the composition of powders is about 12 $g/cm^3$.

18. The shaped charge liner of claim 12, wherein:

each of the malleable binding metal powders is about 5% to about 20% w/w of a total weight of the composition; and the non-malleable metal powder is about from 5% w/w to about 39% w/w of a total weight of the composition.

19. The shaped charge liner of claim 12, further comprising at least one of:

a binder; and a lubricant material, wherein the lubricant material is present in up to about 1.5% w/w of the total weight of the composition of powders.

* * * * *